United States Patent [19]

Komarov et al.

[11] 4,088,159

[45] May 9, 1978

[54] LOOM DEVICE FOR HOLDING WEFT THREAD ENDS

[76] Inventors: Jury Ivanovich Komarov, ulitsa Miklukho-Maklaya, 29, korpus 1, kv. 215; Dmitry Andreyanovich Svirin, 3 Zagorodny proezd, 7, korpus 16, kv. 24; Dmitry Vladimirovich Titov, 13 Parkovaya ulitsa, 27, korpus 2, kv. 49; Viktor Mikhailovich Lukhmanov, Nagatinskaya naberezhnaya, 14, korpus 4, kv. 161, all of Moscow, U.S.S.R.

[21] Appl. No.: 764,540

[22] Filed: Feb. 1, 1977

[30] Foreign Application Priority Data

| | | |
|---|---|---|
| Feb. 6, 1976 | U.S.S.R. | 2322827 |
| Mar. 23, 1976 | U.S.S.R. | 2331151 |

[51] Int. Cl.[2] ..... D03D 47/26

[52] U.S. Cl. ..... 139/194

[58] Field of Search ..... 139/194, 436

[56] References Cited

U.S. PATENT DOCUMENTS

| | | | |
|---|---|---|---|
| 3,792,723 | 2/1974 | Titov et al. | 139/194 |
| 3,851,679 | 12/1974 | Titov et al. | 139/194 |

*Primary Examiner*—Henry S. Jaudon

*Attorney, Agent, or Firm*—Steinberg & Blake

[57] ABSTRACT

The present invention relates to devices for holding an end of a weft thread and may be most effectively used on looms wherein the beating-up of the weft thread is performed by beat-up elements. This device includes two groups of shaped plates with notches and projections installed at each selvage of the cloth, the plates of one group being arranged closely adjacent the plates of the other group so that the projections of both are arranged against one another, thereby forming a gap for receiving the weft thread which frictionally engages the projections. Due to such an arrangement, sufficient braking of the weft thread and, consequently, reliable prevention thereof from axial displacement are ensured.

2 Claims, 4 Drawing Figures

LOOM DEVICE FOR HOLDING WEFT THREAD ENDS

The present invention relates to looms and, more particularly, to devices for holding an end of a weft thread used thereon.

The present invention may be most effectively used on looms wherein the beating-up of the weft thread is performed by beat-up elements made as a conventional reed or as beat-up disks with teeth.

At present, there are known devices for holding an end of a weft thread on looms, including two groups of shaped plates with cuts and projections, installed on shafts at the selvages of the cloth. The plates of one of the groups are always disposed between the beat-up elements of the loom, whereas the plates of both groups are mutually arranged so that between the projections thereof a tunnel is formed for the weft thread to be introduced by the beat-up elements (cf. U.S. Pat. No. 3,851,679; Cl. 139, 1974). Therewith, the plates of one group are located between the plates of the other group, as a result of which the thread alternately entrails the butts of the projections of the plates.

Although the prior art devices ensure holding of the end of the weft thread, these devices, due to the plates of one group being arranged between the plates of the other group, do not provide for sufficient braking of the thread, whereby the latter is free to move in the axial direction. As a consequence, the thread is secured unreliably and, therefore, the cloth selvage formed therefrom is insufficiently strong.

An object of the present invention is to obviate the above disadvantages.

It is thus an object of the present invention to provide a device for holding an end of a weft thread, wherein shaped plates of two groups are arranged so as to provide for reliable securing of the end of the weft thread.

The principal object of the present invention is to provide a device which will provide for sufficient braking of the thread.

Another object of the present invention is to provide a device which will enhance the quality of the selvage of the formed cloth.

These and other objects are attained by that in a device for holding an end of a weft thread on looms comprising two groups of shaped plates with notches and projections installed on shafts at the selvages of the cloth, with the plates of at least one of the groups always disposed between beat-up elements of the loom and the plates of the other group installed relative to the plates of the one group so that a gap is formed between their projections to receive the weft thread introduced by the beat-up elements. According to the invention, the plates and the projections of one group are arranged closely adjacent the plates and the projections of the other group so that a weft thread received in a gap defined between these projections will frictionally engage the projections. Such mutual arrangement of the plates considerably increases the number of points of contact of the thread with the plates whereby sufficient braking of the thread is ensured and axial displacement thereof is almost completely eliminated. This occurs due to the number of the shaped plates, as compared with the prior art, being twice as large without the overall size of the device as a whole being increased. Because of sufficient braking the end of the weft thread is reliably secured and a strong selvage of the cloth is obtained.

To further increase the braking force it is preferable that the edges of the opposite projections of the plates of each group be provided with parallel bevels.

Given below is a detailed description of the present invention with reference to the accompanying drawings, wherein.

Figure 1:
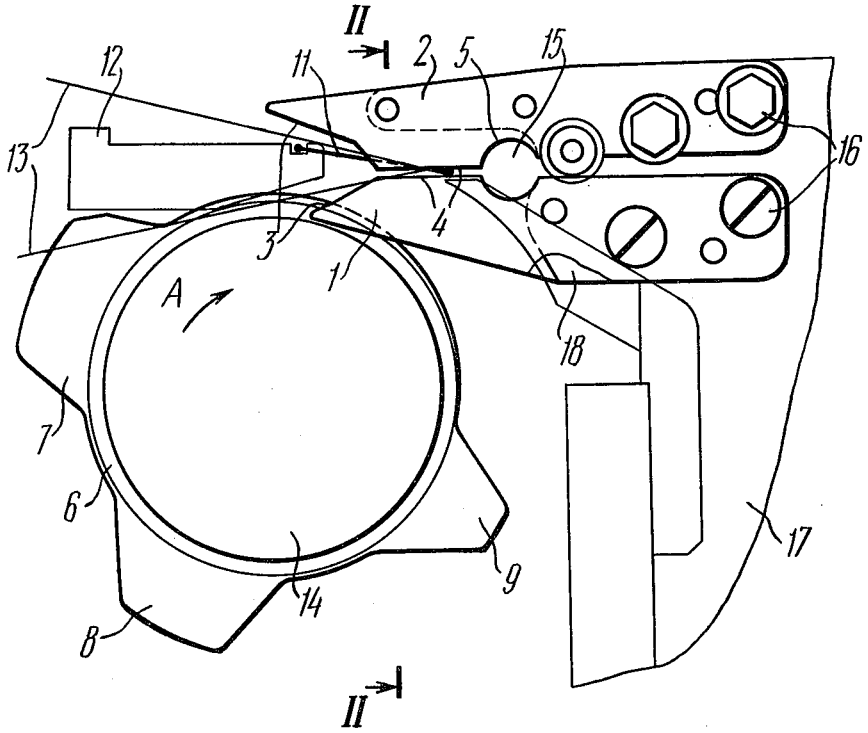
FIG. 1 is a side view of a beat-up mechanism with a device for holding an end of a weft thread, according to the invention.
Figure 2:
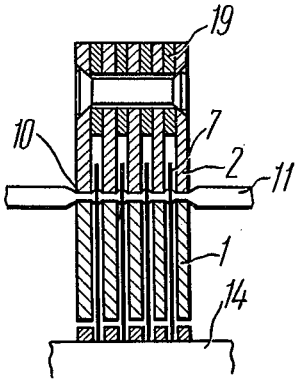
FIG. 2 is a section view taken along line II—II of FIG. 1.

Referring now to the drawings, the proposed device comprises two groups of shaped plates 1 and 2 (FIG. 1) installed at each selvage of the cloth, each plate having a guiding edge 3, a projection 4 and a notch 5. The plates 1 or 2 always occupy the gaps between disks 6 with teeth 7, 8 and 9, said disks 6 serving as beat-up elements. The plates 1 (FIG. 2) are placed closely adjacent to the plates 2 so that their projections 4 are also closely adjacent to one another, and formed between these projections is a gap 10 for a weft thread 11 to be introduced by the disks 6 (FIG. 1). This gap 10 is narrower than the diameter of the weft thread so that the latter will be compressed between and engaged by the projections. The weft thread 11 is laid by a carrier 12 in the shed formed by warp threads 13 and is forced to the fell of the cloth by the teeth 7, 8, 9 of the disks 6. The disks 6 are mounted on a drive shaft 14 and the sense of their rotation is conventionally shown in the drawing by arrow "A." The shaft 14 is driven into motion by a mechanism of any known construction.

Formed between the opposite notches 5 of the plates 1 and 2 of each group is a cavity 15 wherein the ends of the weft threads 11 are disengaged from the projections 4 of these plates.

The plates 1 and 2 are installed at the fell and adjacent the selvages of the cloth on shafts 16 secured in brackets 17. Between the plates there are placed gaskets 18 and 19 (FIG. 3) forming gaps 20 accommodating the teeth 7, 8, 9 of the beat-up disks 6. However, said gaps 20 may be obtained by milling slots in the bases of the plates 1 and 2 as is shown in FIG. 4.

Figure 3:
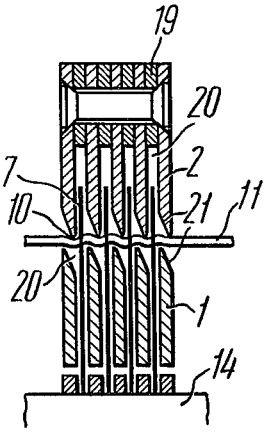
FIG. 3 shows a cross-section of an alternative embodiment of the shaped plates.
Figure 4:
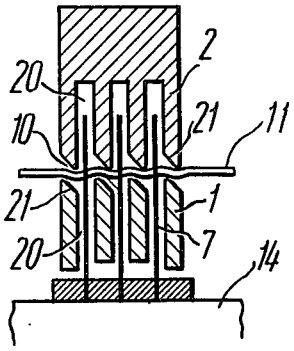
FIG. 4 shows a cross-section of another embodiment of the shaped plates.

On adjacent edges of the plates 1 and 2 of each group bevels 21 are made parallel with one another in the embodiments of FIGS. 3 and 4.

The device operates as follows.

When the loom has started, the disks 6 start rotating and their teeth 7, while sliding along a bevelled surface of the carrier 12, shift the latter in the shed of the warp threads 13. At the entrance into and at the exit from the shed, the carrier 12 passes the shaped plates 1 and 2 installed at the selvages of the cloth wherein the ends of the weft threads 11 are secured. As the disks 6 rotate, their teeth 7, 8, 9 displace the end of the weft thread 11 towards the guiding edges 3 of the plates 1 and 2, then carry the end along the projections 4 and introduce it into the gap 10 wherein it frictionally moves along the projections 4 as if becoming wedged therebetween and secured on the plates 1 and 2. After the beating-up, this end remains in the gap 10 as the thread 11 remains in the fell of the cloth and ceases moving axially. Due to the arrangement of the plates 1 and 2, the number of braking points of the thread 11 becomes greater, whereby the latter is prevented from axial displacement more reliably.

The carrier 12 travels through the shed, and the weft thread 11 secured in the shaped plates 1 and 2 is unwound from the spool of said carrier and, after being forced by the teeth 7–9 of the disks 6 to the fell of the cloth, remains therein.

The ends of the weft threads 11 inserted into the gap 10 are shifted with the cloth and after reaching the cavity 15 emerge from this gap, are released from the shaped plates 1 and 2 and remain at the selvage.

Subsequently, the process of gripping and holding of the ends of the weft threads continues.

All ends of the weft threads placed into the gap 10 and advancing as far as the cavity 15 are reliably prevented from axial displacement by frictional engagement with the plates 1 and 2, thereby keeping the fell of the cloth from narrowing which may occur due to weft shrinkage. As a result, the warp threads 13 are arranged parallel with one another without skewing at the selvages of the cloths and do not become frayed when acted upon by the rotating beat-up disks 6. In this way, the breakage of the warp threads is prevented.

The herein disclosed device ensures: holding of the ends of the weft threads at the beginning of the laying thereof, accomplishment of the laying of the weft threads through the shed of the warp threads, securing of the end of the weft thread and holding thereof during laying.

What is claimed is:

1. A device for holding ends of a weft thread on a loom having a rotary shaft carrying beat-up elements, comprising: two groups of shaped plates arranged in planes perpendicular to said rotary shaft opposite one another, installed on shafts adjacent each selvage at the fell of the cloth, each said plate having a notch and a projection, said plates of at least one of said groups always occupying gaps between the beat-up elements of the loom; said plates of one group being arranged closely adjacent the plates of the other group so that their projections are also arranged closely adjacent one another forming there between a gap of less width than the thickness of the weft thread wherein the weft thread frictionally engages the projections of the plates, as a result of which the thread end is frictionally held at the selvages of the cloth.

2. A device as claimed in claim 1, wherein thread projections of the plates of each group are provided with parallel bevels.

* * * * *